United States Patent [19]

Wiens

[11] Patent Number: 5,027,531

[45] Date of Patent: Jul. 2, 1991

[54] APPARATUS FOR DRYING HOSES IN A FIRE HALL

[76] Inventor: Clifford Wiens, 2139 Albert Street, Regina, Saskatchewan, Canada, S4P 2V1

[21] Appl. No.: 557,316

[22] Filed: Jul. 23, 1990

[51] Int. Cl.[5] ..... F26B 9/06

[52] U.S. Cl. ..... 34/104; 248/89; 248/90

[58] Field of Search ..... 34/104, 164, 21, 239, 34/240, 151, 243 R; 248/89, 90, 75, 80, 125

[56] References Cited

U.S. PATENT DOCUMENTS

| | | | |
|---|---|---|---|
| 485,694 | 11/1892 | Haskell | 34/164 |
| 604,231 | 5/1898 | Devendorf et al. . | |
| 1,332,326 | 3/1920 | Dubois . | |
| 2,260,244 | 10/1941 | Walter | 34/104 |
| 2,943,833 | 7/1960 | Ramse | 248/89 |
| 2,972,462 | 2/1961 | Burton et al. | 248/80 |
| 4,216,931 | 8/1980 | Harless et al. | 248/89 |
| 4,403,424 | 9/1983 | Wahlström et al. | 34/104 |
| 4,862,602 | 9/1989 | Krill | 34/240 |

FOREIGN PATENT DOCUMENTS

| | | | |
|---|---|---|---|
| 1097424 | 7/1955 | France | 34/239 |
| 20654 | of 1890 | United Kingdom | 34/239 |
| 23308 | of 1895 | United Kingdom | 34/239 |

*Primary Examiner*—Henry A. Bennet
*Assistant Examiner*—Denise L. Gromada
*Attorney, Agent, or Firm*—Adrian D. Battison; Stanley G. Ade; Murray E. Thrift

[57] ABSTRACT

A rack is provided for mounting in a fire hall for drying of hoses after use in a manner which avoids the necessity for a tower of sufficient height to receive the full length of the hoses. The rack comprises a plurality of shelves mounted upon a central support at a midpoint along the length of the shelves and mounting upon rollers at the outer ends. The central support can be raised vertically upwardly along the wall of the fire wall so that the ends move inwardly to a position at approximately a 45° angle thus bending the hoses at a central position into two inclined portions from which the water can be drained.

11 Claims, 2 Drawing Sheets

APPARATUS FOR DRYING HOSES IN A FIRE HALL

BACKGROUND OF THE INVENTION

This invention relates to an apparatus for drying hoses in a fire hall.

When returning from a fire, the fire truck or pumper truck carries hoses which are at least wet on the interior and exterior surfaces and in a worst condition can be frozen with the layer of ice filling the hose and thus forming a blockage. Hoses of this type are generally approximately fifty (50) feet in length with suitable quick release couplings at either end for connection to the pumper truck or other equipment at the outer end. It is of course therefore essential that when the hoses are returned to the fire hall they be properly dried before storage to avoid deterioration of the hose and also to ensure that the hose is fully available for use at the next occasion.

Some fire halls include a tower which is at least fifty feet in height in which case one end of the hose can be attached to a suitable support which is then pulled up to the tower allowing the remainder of the hose to hang downwardly for draining and drying.

Many fire halls and particularly those designed recently do not include a tower of this type and hence cannot accomodate the hoses suspended in vertical orientation.

One arrangement which has been proposed as shown in U.S. Pat. No. 4,216,931 (Harless) in which a frame structure includes a plurality of brackets each for supporting a respective hose so that a centre portion of the hose can be looped over the bracket and then the whole support raised vertically to a height of at least twenty five feet so that the hoses are draped and hang downwardly in two halves. This arrangement is unsatisfactorY in that it will be difficult to hang the hoses over the brackets while the support is at ground level since the hoses must be draped across the floor. Secondly, the action of simply folding the hose around a single pin can cause wear or damage to the hose structure at the central location leading to a reduced life. Thirdly many fire halls do not even have the capability of lifting a device through the height of twenty five feet so this arrangement is not possible.

A further proposal has been made in which there are provided a series of racks or shelves along one wall of the fire wall which project outwardlY from the wall in parallel overlying relationship. The hoses can then be laid onto the shelves so that a number of hoses lie parallel along the shelves. The length of the shelf is approximately fifty feet to receive the full length of the hose. This arrangement has however the disadvantage that it does not act to properly dry the hose and significant of water quantities can remain in the hose thus increasing the weight and difficulty in handling the hose and also leading to the possibility of degradation of the hose and a reduced life. In this case a shallow angle of inclination can be provided along the length of the hose but this is not sufficient to allow all the water to properly drain from the lower end.

SUMMARY OF THE INVENTION

It is one object of the present invention, therefore, to provide an improved apparatus for supporting hoses during drain for use in a fire hall.

According to the invention, therefore, there is provided a fire hall comprising a floor, a wall extending vertically upwardly from the floor and apparatus for drying hoses in the fire hall comprising an elongate shelf member, a first support for the shelf member arranged adjacent one end of the shelf member, a second support for the shelf member arranged adjacent an opposed end of the shelf member, a third support for the shelf member arranged intermediate the ends of the shelf member, lifting means for raising the third support relative to the first and second supports from a first position in which the shelf member is substantially horizontal to a second position in which a central part of the shelf member is raised above the two ends thereof, said lifting means comprising guide means mounted on the wall and extending from said first position upwardly to the raised second position and means on the third support for engaging the guide means for movement therealong, said first and second supports including means allowing movement thereof inwardly in a direction to reduce the horizontal distance therebetween.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
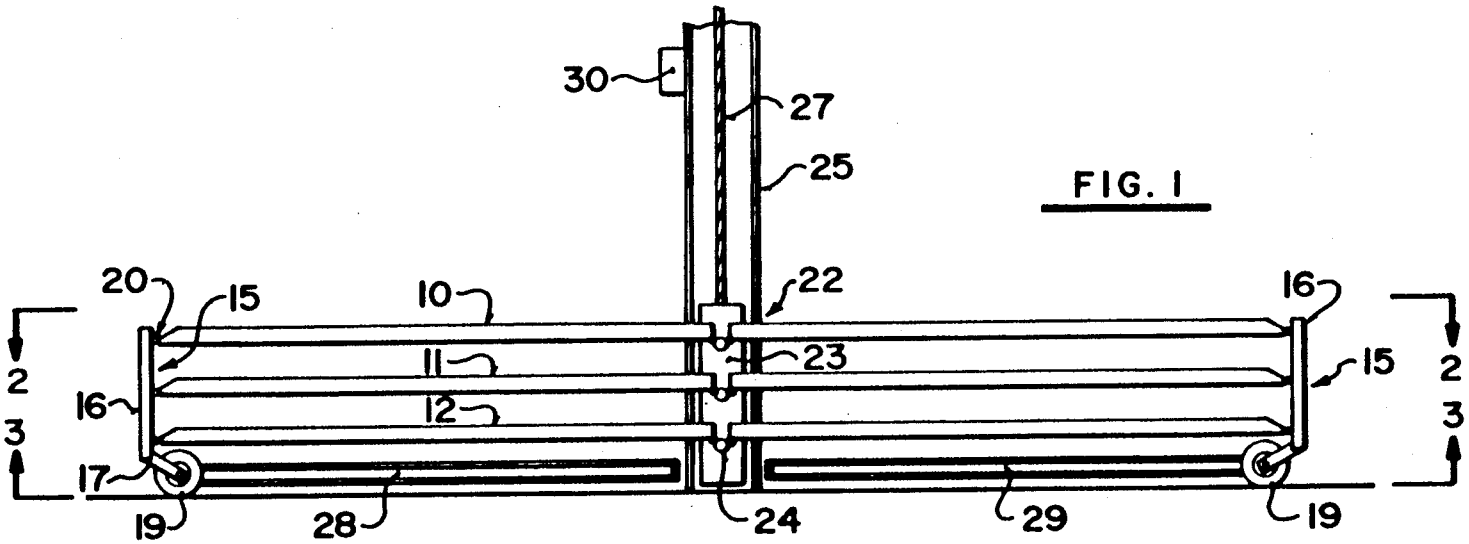
FIG. 1 is a schematic front elevational view of an apparatus according to the present invention.

The apparatus comprises three parallel shelves 10, 11 and 12 each of which in a normal position of the device is horizontal having a length of the order of fifty feet and a width sufficient to receive a number of fire hoses lying side by side across the shelf. The shelf is formed from expanded metal which may be reinforced to provide sufficient structural strength of the length of one half of the shelf to receive and support the hoses without significant bowing. In particular the shelf may have upturned side edges 13 which confine the hoses to remain upon the shelf and also provide additional structural strength. The expanded metal allows any liquid collecting on the shelf to drain through the shelf for collection on the floor 14 beneath the shelf.

At each end shelf there is provided an end support member generally indicated at 15. The end support member comprises a rigid end plate 16 having a width equal to the width of the shelves and a length equal to the spacing between the top shelf and the bottom shelf so that each shelf is attached to the end plate and is supported thereby. The end plate carries at its lower end a strut 17 extending downwardly and inwardly toward the opposed end with a strut being attached to a yoke 18 receiving a ground wheel 19 for rolling over the ground 14. Thus the end plate 16 is supported relative to the ground and can move inwardly and outwardly relative to the ground by rolling action of the ground wheel 19.

Each of the shelves is attached to the end plate 16 by a hinge arrangement 20 which allows pivotal movement of the respective shelf relative to the end plate about an axis defined by the end edge of the shelf. The hinge may be provided by a piano hinge arrangement.

Figure 4:
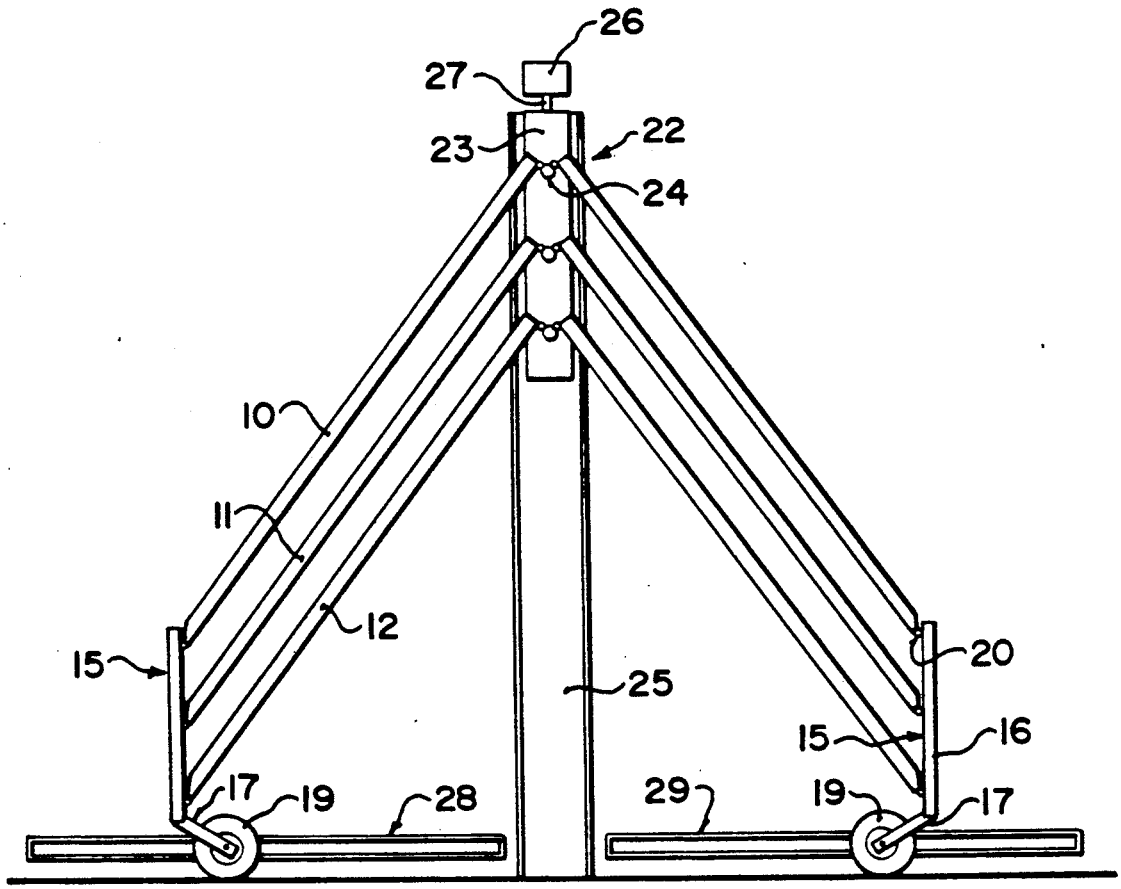
FIG. 4 is a front elevational view similar to that of FIG. 1 showing the apparatus in a raised condition.

A centre support for the shelf members is generally indicated at 22 and includes a vertical beam 23 having a plurality of elongate support members 24 extending outwardly therefrom at right angles in cantilever manner. Each of the support elements divides a respective shelf into two halves each of which can pivot relative to the support element 24 to allow a partial folding action as shown in FIG. 4. Such an arrangement can be provided again by a tubular beam defining the support elements 24 together with a pair of piano hinges each connected to a respective half of the shelf member.

The beam 23 is mounted upon a track element 25 attached to a wall of the fire hall. The track guides the beam 23 in vertical movement up the wall and a motive force provided by a suitable lifting mechanism schematically indicated at 26 including a cable 27.

Also on the wall is provided a pair of guide elements 28 and 29 each for guiding movement of the outer end of the shelf for cooperation with the ground wheel or with the further part of the end support 15 as required.

Figure 2:
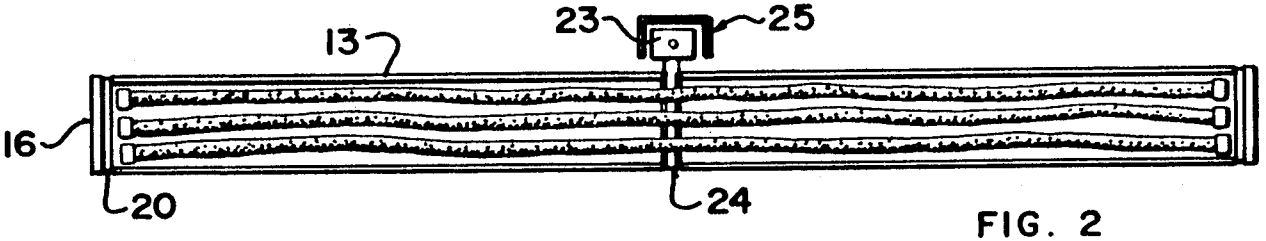
FIG. 2 is a plan view along the lines 2—2 of FIG. 1 showing a number of hoses laid across the upper most one of the shelves.
Figure 3:
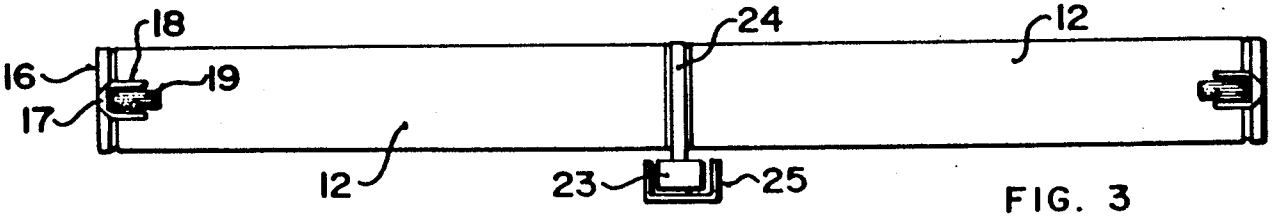
FIG. 3 is a view along the lines 3—3 of FIG. 1.

In operation with the apparatus in the position shown in FIGS. 1, 2 and 3, a plurality of fire hoses are loaded onto the shelves simply by lifting of the hoses by a number of firepersons who roll the hose onto a respective one of the shelves so that the hoses lie side by side as shown in FIG. 2. When the shelf structure is thus fully loaded, the device 26 is actuated to raise the beam 23 vertically upwardly thus folding the shelves the central support and causing the end supports 15 to move inwardly along the guides 28 and 29. Thus the hoses take up an inverted V shaped while the length of the hose is effectively supported upon the two parts of the shelf and the hose is simply and gently bent around the centre section. The two parts of the hose can thus drain effectively since they are inclined at an angle of the order of 45° and possibly greater. In some cases it may be possible where the height is available to lift the centre device substantially so that the shelf members extend vertically or slightly outwardly from the vertical to provide a yet further increased draining action.

An optional attachment may be provided as indicated at 30 in the form of a vibrator mounted upon the track 25 which vibrates the whole unit including the beam 23 and the shelf members to yet further improve the draining action. In this case all of the mountings including the hinge arrangements and the mounting of the track upon the wall will include a rubber bushing arrangement which allows the vibration to occur without damaging forces being transmitted and without causing objectionable noise. This vibration can significantly increase the speed with which ice can be removed from a frozen hose when the hose has been used in very cold weather.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A fire hall comprising a floor, a wall extending vertically upwardly from the floor and apparatus for drying hoses in the fire hall comprising an elongated shelf member, a first support for the shelf member arranged adjacent one end of the shelf member, a second support for the shelf member arranged adjacent an opposed end of the shelf member, a third support for the shelf member arranged intermediate the ends of the shelf member, lifting means for raising the third support relative to the first means and second supports from a first position in which the shelf member is substantially horizontal to a second position in which the central part of the shelf member is raised above the two ends thereof, said lifting means comprising guide means mounted on the wall and extending from said first position upwardly to the raised second position and means on the third support for engaging the guide means for movement therealong, said first and second supports including means allowing movement thereof inwardly in a direction to reduce the horizontal distance therebetween.

2. Apparatus according to claim 1 including a plurality of shelf members in parallel spaced overlying relation.

3. Apparatus according to claim 1 wherein the shelf member is formed from a perforated material.

4. Apparatus according to claim 1 wherein the means allowing movement of the first and second supports comprises roller means for rolling along a support surface.

5. Apparatus according to claim 4 wherein the roller means comprises a ground wheel for rolling upon the ground and supporting the shelf member relative to the ground.

6. Apparatus according to claim 5 wherein the roller support comprise a single ground wheel mounted midway across the width of the shelf member.

7. Apparatus according to claim 2 wherein each of the first and second supports comprises an end member and wherein each of the shelf members includes a hinge coupling for coupling an end of the shelf member to the end member at spaced locations along the length of the end member.

8. Apparatus according to claim 1 including vibrator means for applying a vibratory movement to the third support so as to vibrate the shelf member to assist the release of moisture from the hose.

9. Apparatus according to claim 1 wherein the third support comprises a vertical beam and a cantilever support member extending horizontally outwardly from the vertical beam with the shelf member resting upon the cantilever support member.

10. Apparatus according to claim 9 wherein there is provided a plurality of shelf members and wherein the beam includes a plurality of cantilever support members spaced vertically along the length of the beam each cantilever support member receiving a respective one of the shelf members.

11. Apparatus according to claim 10 including vibrator means mounted on the track for causing vibration of the support beam and the shelf members.

* * * * *